US009377727B2

(12) United States Patent
Yoshioka et al.

(10) Patent No.: US 9,377,727 B2
(45) Date of Patent: Jun. 28, 2016

(54) IMAGE FORMING APPARATUS AND IMAGE FORMING METHOD

(71) Applicant: CANON KABUSHIKI KAISHA, Tokyo (JP)

(72) Inventors: Mahito Yoshioka, Numazu (JP); Satoru Izawa, Suntou-gun (JP); Masahide Hirai, Numazu (JP); Munehito Kurata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/729,276

(22) Filed: Jun. 3, 2015

(65) Prior Publication Data

US 2015/0268602 A1 Sep. 24, 2015

Related U.S. Application Data

(63) Continuation of application No. 13/569,512, filed on Aug. 8, 2012, now Pat. No. 9,091,974.

(30) Foreign Application Priority Data

Aug. 16, 2011 (JP) ..... 2011-178025

(51) Int. Cl.
*G03G 15/20* (2006.01)
*G03G 15/00* (2006.01)

(52) U.S. Cl.
CPC ..... *G03G 15/2039* (2013.01); *G03G 15/2078* (2013.01); *G03G 15/5041* (2013.01); *G03G 15/5058* (2013.01); *G03G 2215/00037* (2013.01)

(58) Field of Classification Search
CPC ..... G03G 15/2039; G03G 15/2087; G03G 15/5041; G03G 15/5058; G03G 15/5062
USPC ..... 399/69, 72
See application file for complete search history.

(56) References Cited

U.S. PATENT DOCUMENTS

| | | | |
|---|---|---|---|
| 5,608,495 | A | 3/1997 | Kitakubo et al. |
| 6,778,788 | B2 | 8/2004 | Tomita et al. |
| 6,898,410 | B2 | 5/2005 | Boss |
| 7,215,899 | B2 | 5/2007 | Kimizuka et al. |
| 7,251,447 | B2 | 7/2007 | Kanamori et al. |

(Continued)

FOREIGN PATENT DOCUMENTS

| | | | |
|---|---|---|---|
| JP | 8-83015 | A | 3/1996 |
| JP | 08139916 | A | 5/1996 |

(Continued)

*Primary Examiner* — Benjamin Schmitt
(74) *Attorney, Agent, or Firm* — Fitzpatrick, Cella, Harper & Scinto

(57) ABSTRACT

The image forming apparatus includes an image processing section that converts image data into pixel data, an image forming section that forms a toner image based on the pixel data, and a fixing section that fixes the toner image to the recording material by heating the recording material with the toner image formed thereon while conveying the recording material through a nip portion. The image processing section divides the pixel data corresponding to one recording material into a plurality of areas each formed of a predetermined number of pixels and acquires density information on some of the pixels within each of the areas as representative values. The fixing section carries out a process of fixing the toner image for which the density information has been acquired, under a fixing condition according to a maximum value of the representative values.

1 Claim, 11 Drawing Sheets

(56) References Cited

U.S. PATENT DOCUMENTS

| | | | | |
|---|---|---|---|---|
| 7,280,775 | B2 | 10/2007 | Kubochi et al. | |
| 7,630,662 | B2 | 12/2009 | Namiki et al. | |
| 8,331,819 | B2 | 12/2012 | Fukuzawa et al. | |
| 2008/0003005 | A1 | 1/2008 | Yamamoto | |
| 2009/0196644 | A1* | 8/2009 | Funatsu | 399/69 |
| 2012/0148281 | A1 | 6/2012 | Fukuzawa et al. | |
| 2012/0308253 | A1 | 12/2012 | Kurata et al. | |

FOREIGN PATENT DOCUMENTS

| | | | |
|---|---|---|---|
| JP | 2005-070136 | A | 3/2005 |
| JP | 2005-321549 | A | 11/2005 |
| JP | 2006-154413 | A | 6/2006 |
| JP | 2009-92688 | A | 4/2009 |

* cited by examiner

IMAGE FORMING APPARATUS AND IMAGE FORMING METHOD

This application is a continuation of application Ser. No. 13/569,512, filed Aug. 8, 2012.

BACKGROUND OF THE INVENTION

1. Field of the Invention

The present invention relates to an image forming apparatus such as a copier or a printer which has a function to form an image on a recording material, and an image forming method.

2. Description of the Related Art

Image forming apparatuses, such as electrophotograhic copiers and printers, generally form images on recording materials in the process described below. First, a photosensitive member is scanned by light from a laser scanner to form an electronic latent image on the member, which is then developed using toner to form a toner image. The toner image is transferred to a recording material directly from the photosensitive member or via an image bearing member such as an intermediate transfer member. Then, the recording material with the toner image transferred thereto is heated and pressed by a fixing apparatus to form an image on the recording material. Here, some fixing apparatuses may include a fixing roller or film that is heated by a heat source and a pressure roller that comes into contact with the fixing roller or film to form a fixing nip.

Fixing conditions for the fixing apparatus are generally set such that the image can be fixed even if the maximum amount of toner that can be allowed for the image forming apparatus is loaded on the recording material, and the fixing conditions may not be changed even with a smaller amount of toner. For example, in a color image forming apparatus, even a text image will be fixed at a fixing temperature at which even a solid image in whole area of the recording material can be fixed. As a result, the image with a small amount of toner is fixed at an excessive temperature. This leads to excessive fixture and may disadvantageously result in hot offset, curling of the recording material, or consumption of more power than is necessary.

To solve these problems, Japanese Patent Application Laid-Open No. 2006-154413 discloses an image forming apparatus using toner in a plurality of colors, which is configured to detect overlap of dots when an image is formed using the dots and to change the fixation setting condition according to the number of overlaps. Furthermore, Japanese Patent Application Laid-Open No. 2009-92688 discloses an image forming apparatus also using toner in a plurality of colors, which is configured to detect overlap of toner colors in one dot line and to change the fixing condition according to the state of the overlap.

However, with the increased resolution and operating speed of recent image forming apparatuses, there is a need for an image forming apparatus which can quickly acquire density information from image data so as to reflect the density information in the fixing condition before a fixing process is started.

SUMMARY OF THE INVENTION

A purpose of the present invention is to enables a reduction in the time required to acquire density information from image data in setting a fixing condition.

Another purpose of the invention is to provide an image forming apparatus forming an image on a recording material, the image forming apparatus including an image processing section that converts image data into pixel data, an image forming section that forms a toner image formed based on the pixel data onto the recording material, and a fixing section that fixes the toner image to the recording material by heating the recording material on which the toner image is formed while conveying the recording material through a nip portion, wherein the image processing section divides the pixel data corresponding to one sheet of the recording material into a plurality of areas each of which is formed by a predetermined number of pixels and acquires density information on some of the pixels within each of the areas as representative values, wherein the fixing section fixes the toner image for which the density information has been acquired, under a fixing condition according to a maximum value of the representative values.

A further purpose of the invention is to provide an image forming method for forming an image on a recording material, the method including converting image data into pixel data, dividing the pixel data corresponding to one recording material into a plurality of areas each of which is formed by a predetermined number of pixels, and acquiring density information on some of the pixels within each of the areas as representative values, forming a toner image for which the density information has been acquired based on the pixel data, onto the recording material; and fixing the toner image for which the density information has been acquired on the recording material, onto the recording material under a fixing condition according to a maximum value of the representative values.

A still further purpose of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Exemplary embodiments of the present invention will be described below with reference to the drawings. However, the dimensions, materials, shapes and relative arrangements of components described in the exemplary embodiments should be changed as necessary according to the configuration of and various conditions for an apparatus to which the present invention is applied, and are not intended to limit the scope of the present invention to the exemplary embodiment described below.

A first exemplary embodiment is described.

(1) Image Forming Apparatus

Figure 1:
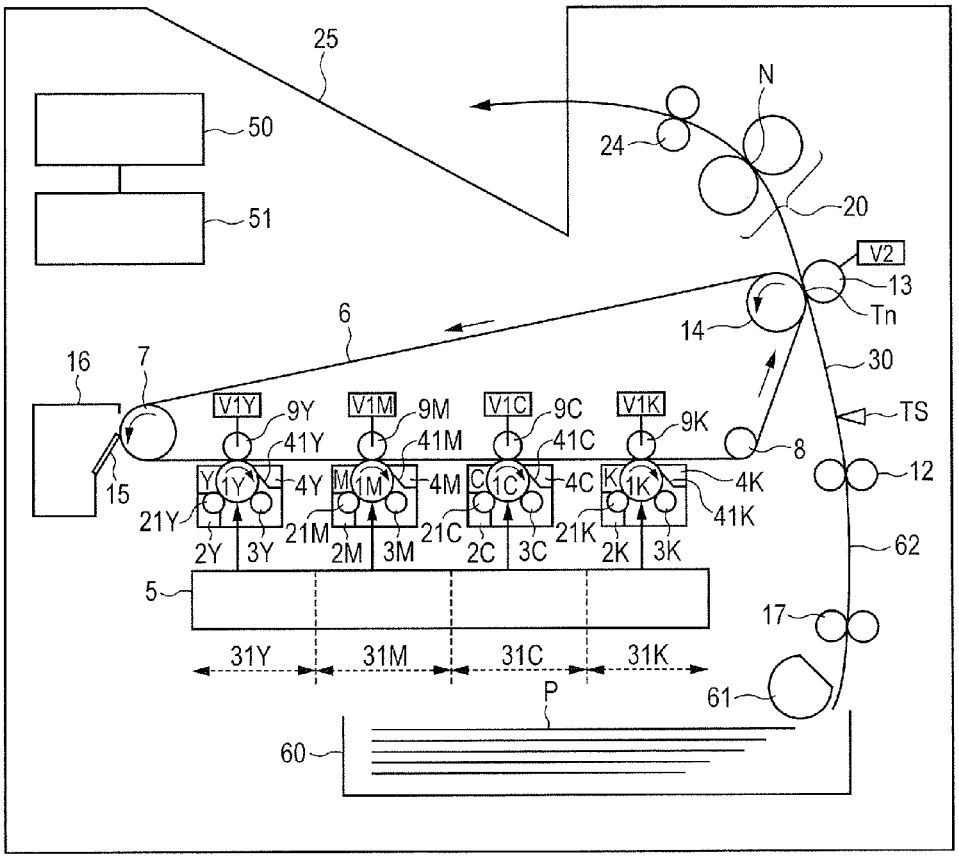
FIG. 1 is a cross-sectional view illustrating a general configuration of an image forming apparatus according to Exemplary Embodiment 1.

FIG. 1 is a cross-sectional view illustrating a general configuration of an image forming apparatus according to Exemplary Embodiment 1. The image forming apparatus is a full color laser printer that uses an electrophotographic scheme to superimpose toner images in four colors, yellow, cyan, magenta and black, on one another to obtain a full color image.

The image forming apparatus illustrated in the present exemplary embodiment includes conveying means 30 for a recording material P, four image forming stations 31Y, 31M, 31C and 31K arranged substantially linearly in a horizontal direction, and a fixing apparatus 20 serving as a fixing unit. Furthermore, the image forming apparatus illustrated in the present exemplary embodiment includes a control section 50 and a video controller 51 that generates an image signal for image formation from image data transmitted by a host computer or an image scanner (not illustrated in the drawings) connected to the image forming apparatus; the video controller 51 serves as an image processing section. The control section 50 and the video controller 51 correspond to a setting unit.

The control section 50 includes memories such as a ROM and a RAM and a CPU. The memories store an image forming control sequence for forming an image on a recording material P and a fixing temperature control sequence for the fixing apparatus 20. Furthermore, the video controller 51 carries out a process of acquiring image density information from received image data.

The image forming station 31Y, one of the four image forming stations 31Y, 31M, 31C and 31K, is a yellow image forming station that forms an image in yellow (hereinafter referred to as Y). The image forming station 31C is a cyan image forming station that forms an image in cyan (hereinafter referred to as C). The image forming station 31M is a magenta image forming station that forms an image in magenta (hereinafter referred to as M). The image forming station 31K is a black image forming station that forms an image in black (hereinafter referred to as K).

The image forming stations 31Y, 31M, 31C and 31K include electrophotographic photosensitive members (hereinafter referred to an electrophotographic photosensitive drums) 1Y, 1M, 1C and 1K, respectively, serving as drum-like image bearing members and charging rollers 3Y, 3M, 3C and 3K, respectively, serving as charging units. Furthermore, the image forming stations 31Y, 31M, 31C and 31K include developing apparatuses 2Y, 2M, 2C and 2K, respectively, serving as developing units and cleaning devices 4Y, 4N, 4C and 4K, respectively, serving as cleaning units.

The electrophotographic photosensitive drum 1Y, the charging roller 3Y, the developing apparatus 2Y and the cleaning device 4Y are housed in one frame and configured as a yellow cartridge Y. The electrophotographic photosensitive drum 1M, the charging roller 3M, the developing apparatus 2M and the cleaning device 4M are housed in one frame and configured as a magenta cartridge M. The electrophotographic photosensitive drum 1C, the charging roller 3C, the developing apparatus 2C and the cleaning device 4C are housed in one frame and configured as a cyan cartridge C. The electrophotographic photosensitive drum 1K, the charging roller 3K, the developing apparatus 2K and the cleaning device 4K are housed in one frame and configured as a black cartridge K. Yellow toner is housed in the developing apparatus 2Y of the yellow cartridge Y. Magenta toner is housed in the developing apparatus 2M of the magenta cartridge M. Cyan toner is housed in the developing apparatus 2C of the cyan cartridge C. Black toner is housed in the developing apparatus 2K of the black cartridge K.

A laser scan exposure apparatus (hereinafter referred to as an exposure apparatus) 5 serves as an exposure unit. The exposure apparatus 5 is provided in association with each of the cartridges Y, M, C and K to expose a corresponding one of the electrophotographic photosensitive drums 1Y, 1M, 1C and 1K to form an electrostatic image.

An intermediate transfer belt (intermediate transfer member) 6 serves as an endless belt-like image beating ember. The intermediate transfer belt 6 is provided along a direction in which the image forming stations 31Y, 31M, 31C and 31K are arranged. The intermediate transfer belt 6 is adapted to lay around three rollers, a driving roller 7, a tension roller 8, and a secondary transfer opposite roller 14 with a tension. The intermediate transfer belt 6 is driven by the driving roller 7 to move circularly in the direction of an arrow illustrated in FIG. 1 along the electrophotographic photosensitive drums 1Y, 1M, 1C and 1K of the image forming stations 31Y, 31M, 31C and 31K.

Primary transfer rollers 9Y, 9M, 9C and 9K are used as primary transfer units that transfer toner images on front surfaces of the electrophotographic photosensitive drums 1Y, 1M, 1C and 1K, respectively, to an outer peripheral surface (front surface) of the intermediate transfer belt 6. The primary transfer rollers 9Y, 9M, 9C and 9K are disposed opposite the electrophotographic photosensitive drums 1Y, 1M, 1C and 1K, respectively, across the intermediate transfer belt 6.

A belt cleaning blade 15 serves as a cleaning unit for the intermediate transfer belt 6. The belt cleaning blade 15 is provided opposite the driving roller 7.

A feeding roller 61, a conveyance roller 17, a registration roller 12 and a discharge roller 24 are provided to serve as conveyance units for the recording material P.

Furthermore, the image forming apparatus according to the present exemplary embodiment includes a recording material cassette 60 serving as a recording material supply section. The recording material cassette 60 includes the feeding roller 61 that introduces the recording material P into the image forming apparatus. One of the recording materials P stacked in the recording material cassette 60 is separated and fed by the feeding roller 61 and conveyed through a recording material introduction passage 62 toward the registration roller 12 by the conveyance roller 17.

Upon receiving image data from an external apparatus (not illustrated in the drawings) such as a host computer, the video controller 51 transmits a print signal to the control section 50 and converts the received image data into bit map data. The image forming apparatus according to the present exemplary embodiment has a pixel number of 600 dpi. The video controller 51 creates bit map data corresponding to the pixel number.

Upon receiving a print signal, the control section 50 carries out an image forming control sequence. When the image forming control sequence is carried out, first, the electrophotographic photosensitive drums 1Y, 1M, 1C and 1K rotate in the direction of an arrow illustrated in FIG. 1. Then, outer peripheral surfaces (front surfaces) of the electrophotographic photosensitive drums 1Y, 1M, 1C and 1K are uniformly charged to a predetermined polarity and a predetermined potential by the charging rollers 3Y, 3M, 3C and 3K, respectively. According to the present exemplary embodiment, the front surfaces of the electrophotographic photosensitive drums 1Y, 1M, 1C and 1K are charged to a negative polarity.

Then, the exposure apparatus 5 emits laser light corresponding to an image signal based on the bit map data to the charged surface of front surface of each of the electrophotographic photosensitive drums 1Y, 1M, 1C and 1K to scan and expose the charged surface. Thus, an electronic latent image corresponding to the image data is formed on the charged surface of front surface of each of the electrophotographic photosensitive drums 1Y, 1M, 1C and 1K.

The developing apparatuses 2Y, 2M, 2C and 2K set development biases applied by a development bias power source (not illustrated in the drawings) to developing rollers 21Y, 21M, 21C and 21K, respectively, to appropriate values each between a charging potential and a latent image (exposure section) potential. Thus, toner charged to the negative polarity is obtained. The toner charged to the negative polarity is moved from the developing rollers 21Y, 21M, 21C and 21K and selectively attached to the electrostatic latent images on the front surfaces of the electrophotographic photosensitive drums 1Y, 1M, 1C and 1K, respectively. Hence, the electrostatic latent images are developed.

The toner images developed on the front surfaces of the electrophotographic photosensitive drums 1Y, 1M, 1C and 1K by the developing apparatuses 2Y, 2M, 2C and 2K, respectively, are transferred to the outer peripheral surface (front surface) of the intermediate transfer belt 6 rotating in synchronism with the rotation of the electrophotographic photosensitive drums 1Y, 1M, 1C and 1K at a speed substantially equal to the speed of the electrophotographic photosensitive drums 1Y, 1M, 1C and 1K. That is, first transfer bias power sources V1Y, V1M, V1C and V1K apply transfer biases with a polarity opposite to the polarity of the toner to the primary transfer rollers 9Y, 9M, 9C and 9K corresponding to the electrophotographic photosensitive drums 1Y, 1M, 1C and 1K, respectively. Thus, the toner images in the respective colors from the front surfaces of the electrophotographic photosensitive drums 1Y, 1M, 1C and 1K are primarily transferred to a front surface of the intermediate transfer belt 6. Thus, a color toner image is borne on the front surface of the intermediate transfer belt 6.

Transfer remaining toner remaining on the front surfaces of the electrophotographic photosensitive drums 1Y, 1M, 1C and 1K is removed by cleaning members 41Y, 41M, 41C and 41K provided in the cleaning devices 4Y, 4M, 4C and 4K, respectively. Then, the transfer remaining toner removed by the cleaning members 41Y, 41M, 41C and 41K is collected in waste toner containers provided in the cleaning devices 4Y, 4M, 4C and 4K, respectively. According to the present exemplary embodiment, cleaning blades made from urethane blades are used as cleaning members.

As described above, a charging step by the charging rollers, an exposure step by the exposure apparatuses, a developing step by the developing members, and a primary transfer step by the primary transfer rollers 9 are carried out on each of the color, yellow, magenta, cyan and black in synchronism with the rotation of the intermediate transfer belt 6.

In this manner, the toner images in the respective colors are sequentially superimposed on the front surface of the intermediate transfer belt 6. Thus, the intermediate transfer belt 6 has a function to bear unfixed toner images of color images to be formed on the recording material P.

On the other hand, one of the recording materials P set in the recording material cassette 60 is fed by the feeding roller 61 and conveyed through a recording material introduction passage 62 to the registration roller 12 by the conveyance roller 17. The recording material P conveyed by the registration roller 12 has its leading end detected by a top sensor TS provided immediately after the registration roller 12. In response to the detection of the leading end of the recording material P by the top sensor TS, the registration roller 12 conveys the recording material P to a transfer nip portion Tn between the intermediate transfer belt 6 and a secondary transfer roller 13 serving as a secondary transfer unit, in synchronized timing with the image position on the front surface of the intermediate transfer belt 6.

The transfer nip portion Tn is formed between the intermediate transfer belt 6 and the secondary transfer roller 13 by arranging the secondary transfer roller 13 in contact with the front surface of the intermediate transfer belt 6 at a position where the secondary transfer roller 13 lies opposite the secondary transfer opposite roller 14. In the image forming apparatus according to the present exemplary embodiment, the recording material P is conveyed at a speed of 180 mm/sec.

The color toner images borne on the front surface of the intermediate transfer belt 6 are transferred at a time (secondary transfer) to the recording material P by a bias which is opposite to the bias of the toner and which is applied to the secondary transfer roller 13 by a second transfer bias power source V2.

Here, the image forming stations 31Y, 31M, 31C and 31K, the exposure apparatus 5, the intermediate transfer belt 6 and the secondary transfer roller 13 correspond to a toner image forming unit that forms toner images on the recording material based on input image data.

The color toner images transferred onto the recording material P are introduced into the fixing nip portion N of the fixing apparatus 20 serving as a fixing unit. The color toner images are then heated and pressed and thus fixed onto the recording material P under heat. The recording material P exits the fixing nip portion N of the fixing apparatus 20 and is discharged onto a discharge tray 25 by a discharge roller 24.

The transfer remaining toner remaining on the front surface of the intermediate transfer belt 6 after the transfer of the color toner image is removed by the belt cleaning blade 15. The transfer remaining toner removed by the belt cleaning blade 15 is collected in a waste toner container 16. According to the present exemplary embodiment, the cleaning blade made from a urethane blade is used as a cleaning member.

(2) Fixing Apparatus

Figure 2:
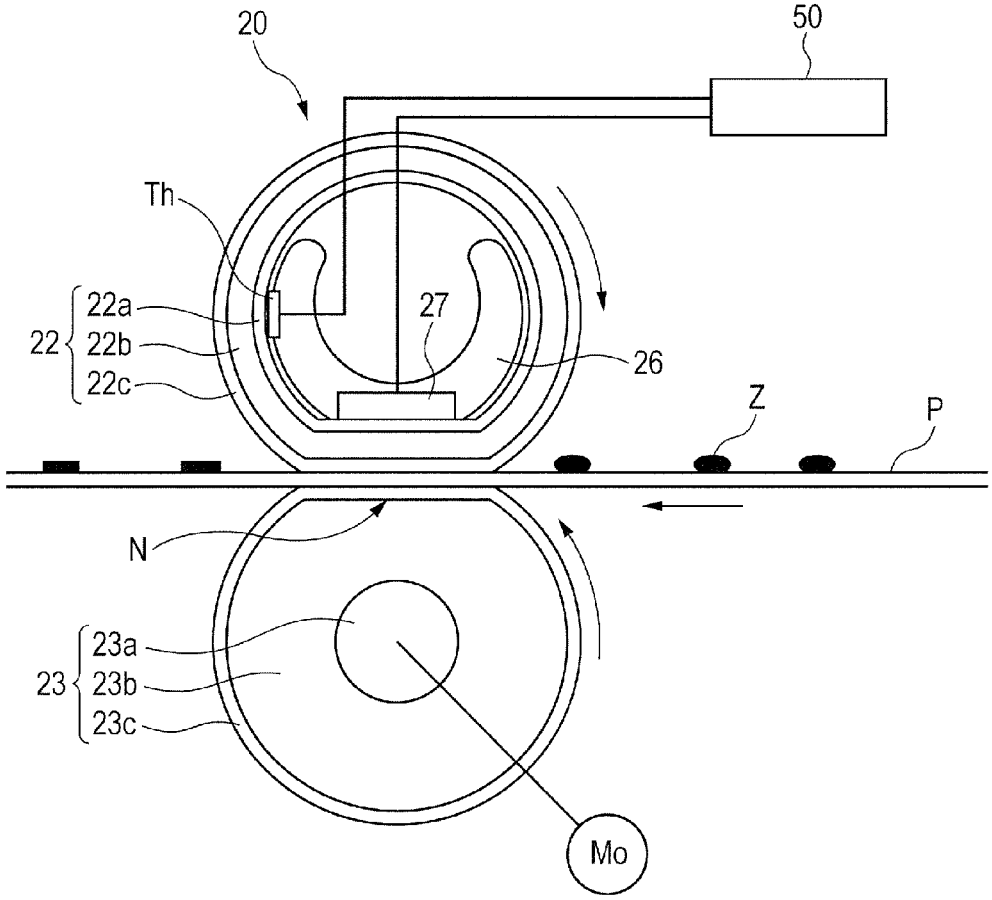
FIG. 2 is a cross-sectional view illustrating a general configuration of a fixing apparatus according to Exemplary Embodiment 1.

FIG. 2 is a cross-sectional view showing a general configuration of a fixing apparatus 20 according to the present exemplary embodiment. The fixing apparatus 20 is a film-based fixing apparatus. In the description below, in connection with the fixing apparatus and members forming the fixing apparatus, a longitudinal direction refers to a direction orthogonal to a recording material conveyance direction in the image forming surface of the recording medium. Furthermore, a lateral direction refers to a direction parallel to the recording material conveyance direction in the image forming surface of the recording medium. Additionally, a width refers to a dimension in the latitudinal direction.

The fixing apparatus 20 includes a ceramic heater 27 serving as a heating unit, and a fixing film 22 and a pressure roller 23 both serving as fixing members. The ceramic heater 27, the fixing film 22, and the pressure roller 23 are members that are elongate in the longitudinal direction. Here, the direction of a rotating shaft of the pressure roller 23 is the same as the longitudinal direction.

A heater holder 26 contained in the fixing film 22 is formed of a heat resistant resin such as a semicircular liquid crystal polymer. The heater holder 26 holds the ceramic heater 27 and a thermistor Th serving as a temperature detection unit. Furthermore, the heater holder 26 also serves as a guide for the fixing film 22.

The fixing film 22 includes a cylindrical metallic base layer 22*a*. An elastic layer 22*b* that is thinned silicone rubber is formed on an outer peripheral surface of the base layer 22*a*. Moreover, a release layer 22*c* is formed on an outer peripheral surface of the elastic layer 22*b*; the release layer 22*c* is formed of one of polytetrafluoroethylene (PTFE) and a perfluoroalkoxytetrafluoroethylene copolymer (PFA) that exhibit excellent releasability.

The ceramic heater 27 in the fixing film 22 includes a base material such as alumina or aluminum nitride and a heating element located on the base material and formed of silver paste. The ceramic heater 27 is energized by a power source (not illustrated in the drawings) to heat an outer peripheral surface (front surface) of the fixing film 22 via the base layer 22*a*, the elastic layer 22*b*, and the release layer 22*c*.

The pressure roller 23 includes a cored bar 23*a* formed of aluminum or stainless steel and shaped like a round shaft. The cored bar 23*a* includes an elastic layer 23*b* formed on an outer peripheral surface thereof and which is thickened silicone rubber or foamed silicone rubber. Moreover, a release layer 23*c* formed of one of PTFE and PFA is provided on an outer peripheral surface of the elastic layer 23*b* to serve as an outermost layer.

The pressure roller 23 is disposed substantially parallel to the fixing film 22, with the cored bar 23*a* rotatably held by an apparatus frame at the longitudinally opposite ends thereof.

The longitudinally opposite ends of the cored bar 23*a* of the pressure roller 23 are biased in the axial direction of the fixing film 22 by a pressure unit (not illustrated in the drawings) such as a pressure spring. Thus, the outer peripheral surface (front surface) of the pressure roller 23 is in pressure contact with the front surface of the fixing film 22. The pressing force of the pressure unit elastically deforms the elastic layer 23*b* along a longitudinal direction of the front surface of the fixing film 22 to form a fixing nip portion N with a predetermined width between the front surface of the pressure roller 23 and the front surface of the fixing film 22.

(3) Heated Fixing Operation of the Fixing Apparatus

In accordance with an input print signal, the control section 50 allows a fixing motor Mo (FIG. 2) serving as a driving source to rotationally drive a driving gear (not illustrated in the drawings) provided at one end of the cored bar 23*a* of the pressure roller 23. Thus, the pressure roller 23 is rotated in the direction of an arrow illustrated in FIG. 2. Rotation of the pressure roller 23 allows a torque to act on the fixing film 22 at the fixing nip portion N due to a frictional force between the front surface of the pressure roller 23 and the front surface of the fixing film 22. The torque allows the fixing film 22 to rotate in a driven manner in the direction of an arrow illustrated in FIG. 2 at a substantially the same peripheral speed as that of the pressure roller 23.

Furthermore, the control section 50 turns on a triac (not illustrated in the drawings) serving as an energization control unit. Thus, the ceramic heater 27 is energized by a power source (not illustrated in the drawings). The ceramic heater 27 is energized to heat the base layer 22*a* of the fixing film 22. The heat of the base layer 22*a* is transmitted through the elastic layer 22*b* to the release layer 22*c* to increase the temperature of front surface of the fixing film 22. The temperature of the front surface of the fixing film 22 is indirectly detected by the thermistor Th arranged in contact with the base layer 22*a* of the fixing film 22, which is located in a back surface thereof.

The control section 50 receives an output signal (temperature detection signal) from the thermistor Th. Then, based on the output signal, the control section 50 allows the triac to control power provided to the ceramic heater 27 to maintain the temperature of back surface of the fixing film 22 at a predetermined fixing temperature T.

With the temperature of back surface of the fixing film 22 maintained at the fixing temperature T and while the rotational peripheral speed of the fixing film 22 associated with the rotation of the pressure roller 23 is in a steady state, the recording material P bearing an unfixed color toner image Z is introduced into the fixing nip portion N. Then, at the nip portion N, the recording material P is nipped and conveyed by the front surface of the fixing film 22 and the front surface of the pressure roller 23. The recording material P is subjected to the heat of front surface of the fixing film 22 and the pressure of the fixing nip portion N. Thus, the color toner image Z is fixed onto the recording material P under heat.

(4) Detection of Image Density Information by a Video Controller Section

Now, a method for acquiring density information from image data and a method for setting the fixing temperature in accordance with the density information will be described; the two methods are characteristic of the image forming apparatus according to the present exemplary embodiment. The image forming apparatus according to the present exemplary embodiment can quickly acquire density information from image data to set the optimum fixing condition regardless of the number of pixels in and the print speed of the image forming apparatus, by carrying out steps described below.

As described above, upon receiving image data from an external apparatus (not illustrated in the drawings) such as a host computer, the video controller 51 transmits a print signal to the control section 50 and converts the received image data into bit map data (pixel data) required for image formation. The control section 50 carries out scanning using laser light in accordance with an image signal based on the bit map data. In this case, the image forming apparatus according to the present exemplary embodiment acquires density information from the bit map data within the video controller 51. More specifically, the detection of density information for the colors C, M, Y and K in the image data converted into CMYK image data is carried out within the video controller 51.

Now, a flow from the detection of density information until the setting of the fixing temperature as a fixing condition will be described below with reference to a flowchart illustrated in FIG. 3. FIG. 4 is a diagram illustrating area division of an image forming area (print area or print range) on an image forming surface of the recording material.

When the end of conversion of image data into bit map data within the video controller 51 is detected, the present control flow is started in S101. In S102, the detection of density information is started. Then, for example, as illustrated in FIG. 4, an image forming area to be formed on the recording material P is divided into a plurality of areas each formed of a plurality of pixels. Density information on some of the pixels is detected in each area, and this operation is performed all over the image forming area of the single recording material.

The above-described area is obtained by dividing the image forming area of the single recording material and is formed of a plurality of pixels. The area has a length y in a recording material conveyance direction and a length x in a direction orthogonal to the recording material conveyance direction. For density information for the area, the present exemplary embodiment acquires density information on some of the pixels within the area as representative values for the area instead of detecting density information on all the pixels within the area. The acquisition of the representative values is carried out all over the image forming area. Here, the representative values may be density information on pixels located at preset positions within the area or density information on pixels located at any positions within the area. The size of the area (the number of pixels within the area) and the number of the representative values acquired will be described below. Image information within the video controller 51 is an 8 bit signal, and density data per toner color is represented as a value ranging representing value the minimum density 00 h to the maximum density FFh.

Then, a fixing condition corresponding to the maximum value of the plurality of representative values acquired for each area is determined to be a preset fixing condition for image formation. The toner image for which density information has been acquired is fixed.

According to the present exemplary embodiment, density information is acquired by extracting data of the maximum density (hereinafter referred to as max-d) within one page of the recording material P.

Upon determining that the value max-d for each color has been acquired for all the areas of the recording material P (S103), the video controller 51 adds the values max-d for all the colors together (C (max-d)+M (max-d)+Y (max-d)+K (max-d)) to obtain a total value D (S104). The D value is 2 bytes of 8 bit signals. Subsequently, the video controller 51 transmits the D value to the control section 50 (S105).

The steps S101 to S105 (the range of steps enclosed by a dashed line S10 in FIG. 3) corresponds to the control flow of the video controller 51. The steps S111 to S117 enclosed by a dashed line S11 in FIG. 3 corresponds to a control flow of the control section 50.

Figure 5:
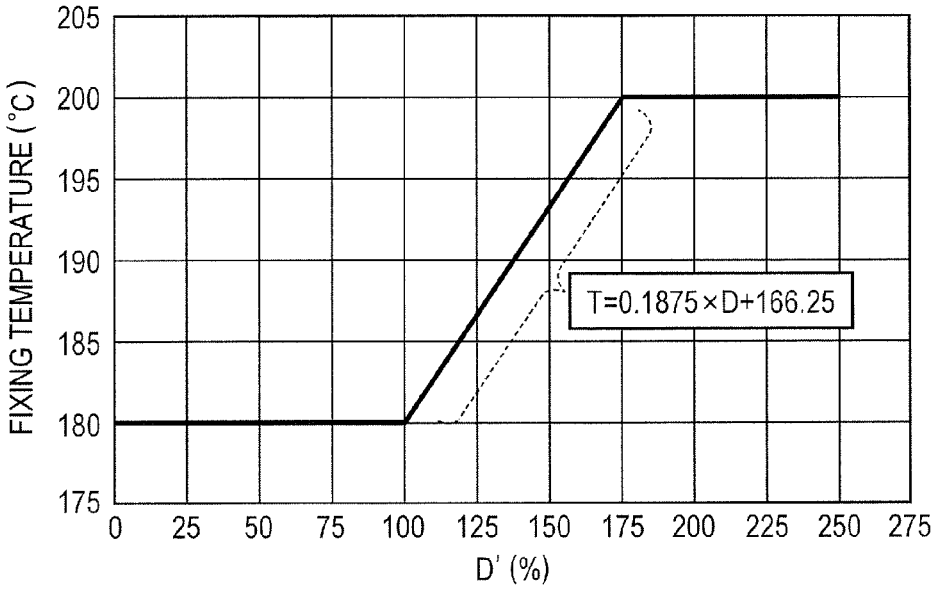
FIG. 5 is a diagram illustrating the relationship between density information and a fixing temperature according to Exemplary Embodiment 1.

In S111, the value D transmitted by the video controller 51 is converted from the 8 bit signal into a value (D') that is treated as density information by the control section 50. The value D' is obtained by converting the value D (8 bit data) into a % density value. Specifically, the minimum density 00 h per toner color corresponds to 0%, and the maximum density FFh per toner color corresponds to 100%. The % value (density information) correlates with the amount of toner per unit area on the actual recording material P. In the present exemplary embodiment, the amount of toner on the recording material is 0.50 mg/cm$^2$ =100%. Furthermore, the value D' is the total of the maximum density values for the plurality of toner colors and may thus exceed 100%. However, the image forming apparatus according to the present exemplary embodiment adjusts the above-described development bias value by setting the upper limit of the amount of toner on the recording material P (which corresponds to the maximum density) to 1.00 mg/cm$^2$ (which is equivalent to 200% in terms of the D' value) for a solid image. Subsequently, in S112, the apparatus determines whether the value D' is at most 100%. If the value D' is at most 100%, then in S113, the apparatus determines the fixing temperature T to be 180° C. (reference fixing temperature). If the value D' is greater than 100%, the apparatus sets the fixing temperature to higher than 180° C. according to the value D'. A specific method for determining the fixing temperature if the value D' is greater than 100% involves determining whether or not the value D' is at least 175% (S114), and if the value D' is at least 175%, setting the fixing temperature T to 200° C. (S115). If the value D' is smaller than 175%, the fixing temperature T is set in accordance with the relational expression T=0.1875×D'+166.25 (S116). That is, the setting of the fixing temperature T in accordance with the value D' in S112 to S116 is in such a relationship as illustrated in FIG. 5. The "reference fixing temperature" as used herein refers to a temperature at which the fixing process can be achieved when all the pixels on one recording material have the density of a solid color image.

As described above, the image forming apparatus according to the present exemplary embodiment sets the fixing temperature to 200° C. when the amount of toner per unit area on the recording material P is at least 0.875 mg/cm$^2$ (equivalent to 175%). The image forming apparatus according to the present exemplary embodiment sets the fixing temperature to 180° C. (reference fixing temperature) when the amount of toner per unit area on the recording material P is at most 0.50 mg/cm$^2$ (equivalent to 100%). The image forming apparatus according to the present exemplary embodiment sets the fixing temperature so that a linear relationship holds true as illustrated in FIG. 5 when the amount of toner per unit area on the recording material P is between 0.50 mg/cm$^2$ and 0.875 mg/cm$^2$ (equivalent to between 100% and 175%). The toner image for density information is acquired under the thus set fixing condition (fixing temperature) is fixed to the recording material.

Subsequently, upon determining in S117 that the next page contains no print data, the control section 50 ends the control. If the next page contains any print data, the control section 50 returns to S102 to detect density information in the subsequent pages.

The area size (the predetermined number of pixels) and the number of representative values acquired for each area will be described. The lengths x and y of the area illustrated in FIG. 4 may be different from each other. However, the image forming apparatus according to the present exemplary embodiment sets each of the lengths equal to 18 dots for 600 dpi. The length of 18 dots is determined for the following reason.

Figure 6:
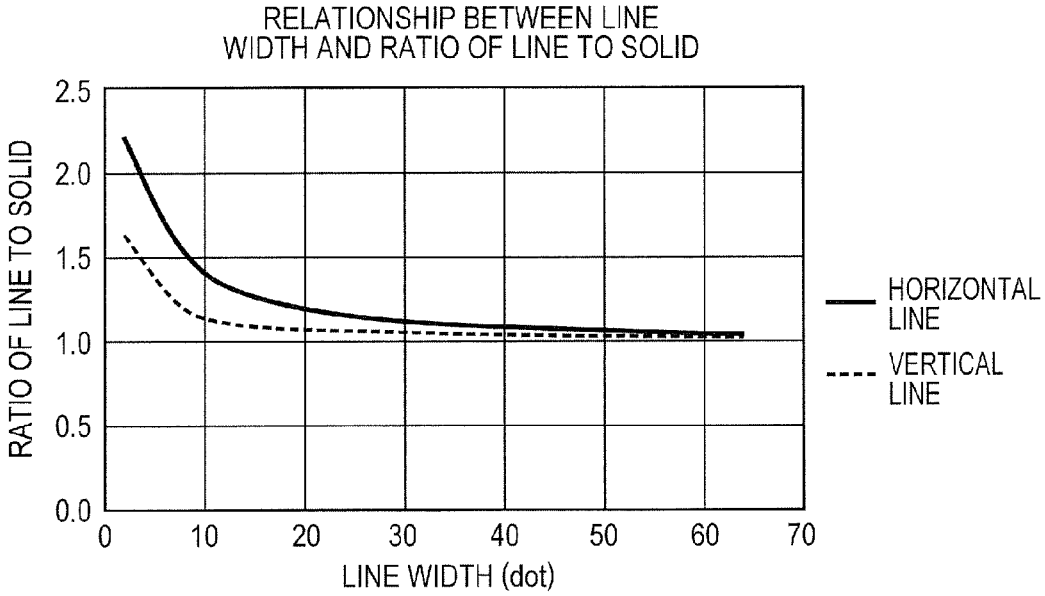
FIG. 6 is a diagram illustrating the relationship between a line width and the ratio of line to solid.

FIG. 6 illustrates the amount of toner per unit area on the recording material P according to the present exemplary embodiment which is represented as the ratio of line to solid (the ratio of line to solid =the amount of toner per unit area on a line / the amount of toner per unit area in an all solid image), wherein the line width is varied. In FIG. 6, the solid line is indicative of a horizontal line, and the dashed line is indicative of a vertical line. For the illustrated ratio of line to solid, the amount of toner per unit area on the recording material P is set to 1.00 mg/cm$^2$ for an all solid image.

As illustrated in FIG. 6, the ratio of line to solid increases with decreasing line width. This tendency is particularly significant with the horizontal line. This is generally known as a phenomenon in which inflow electric fields cause concentrated development of toner in the development section and the transfer section.

Figure 7:
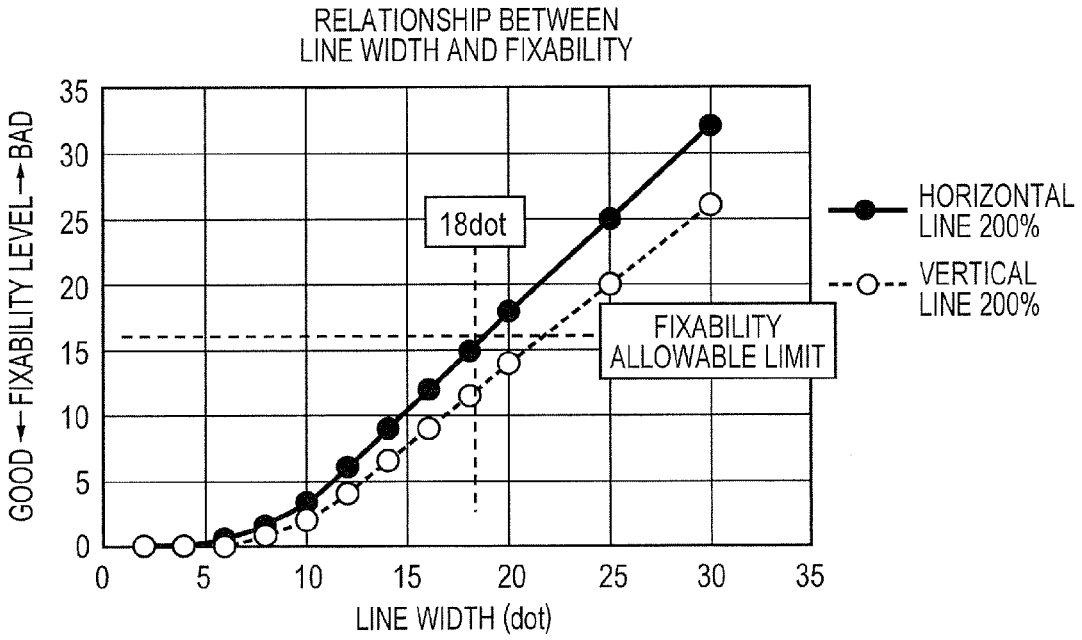
FIG. 7 is a diagram illustrating the relationship between the line width and fixability according to Exemplary Embodiment 1.

On the other hand, the present inventors' experiments indicate that fixability increases with decreasing line width in spite of increased amount of toner per unit area. The results of the experiments are illustrated in FIG. 7. FIG. 7 illustrates the level of fixability observed with the line width varied according to the present exemplary embodiment. An evaluation environment is set at 15° C. and 10% RH, and evaluation paper is Business 4200-105 g manufactured by Xerox Corporation. Furthermore, the fixability level is the total of point values obtained by evaluating print pages resulting from continuous printing of 100 sheets based on the criteria illustrated below in Table 1.

TABLE 1

| Point | Contents of criteria |
|---|---|
| 0 | No damage resulting from rubbing of image with lens-cleaning paper |
| 0.5 | One or two peeling pieces of at most 0.2 mm resulting from rubbing of image with lens-cleaning paper |
| 1.0 | One or two peeling pieces of at most 0.5 mm resulting from rubbing of image with lens-cleaning paper |
| 1.5 | Three or more peeling pieces of at most 0.5 mm resulting from rubbing of image with lens-cleaning paper |
| 2.0 | Some peeling pieces of at least 1.0 mm resulting from rubbing of image with lens-cleaning paper |

In FIG. 7, the solid line is indicative of a horizontal line, and the dashed line is indicative of a vertical line. The amount of toner per unit area in a solid image was set to 1.00 mg/cm$^2$, and the fixing temperature was set to a constant value of 180° C. Here, the fixability level was 15 when the line width was 18 dots. For the actual images, based on the point value evaluation illustrated in Table 1, most of the pages were rated as 0 to 0.5 points, and only the third page was rated as 1.0 point.

On the other hand, for a line width of at least 20 dots, more image pages involved noticeable image damages and were rated as at least 1.5 points.

It is assumed that the fixability allowable limit is 18 dots and that the fixability level is 15. Then, a line width of less than 18 dots makes the fixability fall below the allowable limit and thus offers satisfactory fixability, at 180° C., which is the reference fixing temperature, regardless of the toner concentration. This indicates that setting the fixing temperature to 180° C. eliminates the need to acquire density information.

Figure 8A:
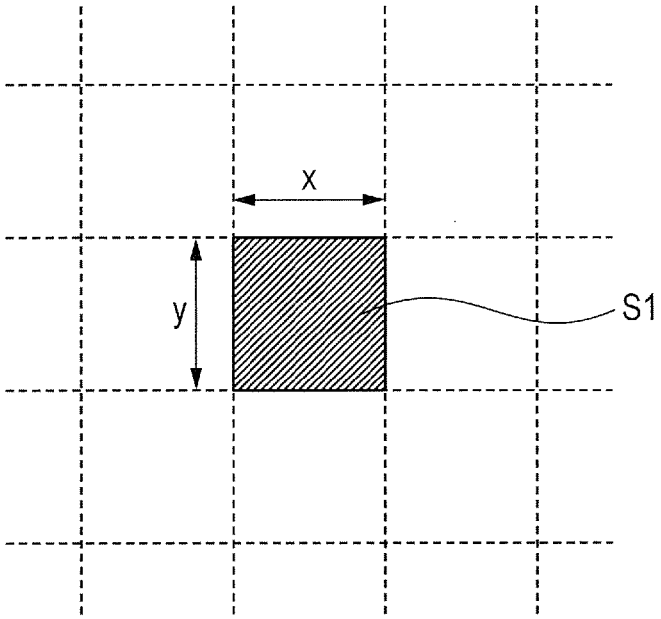
FIGS. 8A and 8B are diagrams illustrating the range of a detection area for the density information according to Exemplary Embodiment 1.
Figure 8B:
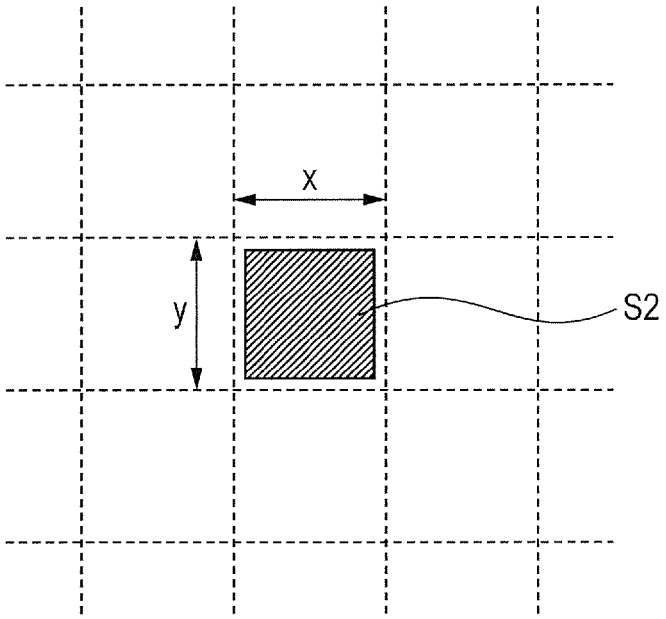

On the other hand, a line width of more than 18 dots makes the fixability exceed the allowable limit and offers unsatisfactory fixability at a fixing temperature of 180° C. Thus, in this case, the fixing temperature needs to be set to higher than 180° C. That is, a line width of more than 18 dots involves the need to acquire density information and to set the fixing temperature to higher than 180° C. according to the density information. FIGS. 8A and 8B are diagrams illustrating the area size (the predetermined number of pixels) for which density information is acquired. If density information can be acquired for such a patch (S1) of at least 18 dots as illustrated in FIG. 8A, the fixability is prevented from being affected even if density information on such a patch (S2) of less than 18 dots as illustrated in FIG. 8B is overlooked. However, the above-described fixability allowable limit is based on the condition that toner is loaded only on a particular line within an image forming area on a single recording material.

Hence, in the image forming apparatus according to the present exemplary embodiment, when each of a plurality of areas into which the image forming area is divided as illustrated in FIGS. 8A and 8B are assumed to have lengths x and y each equal to 18 dots, 324 pixels (the predetermined number of pixels) are present in one area. Furthermore, according to the present exemplary embodiment, the number of representative values acquired for one area is set to one. Thus, compared to the case where density information is acquired for all the pixels in the image forming area on the recording material P, the present exemplary embodiment can reduce the time required to acquire density information to 1/324.

Figure 9:
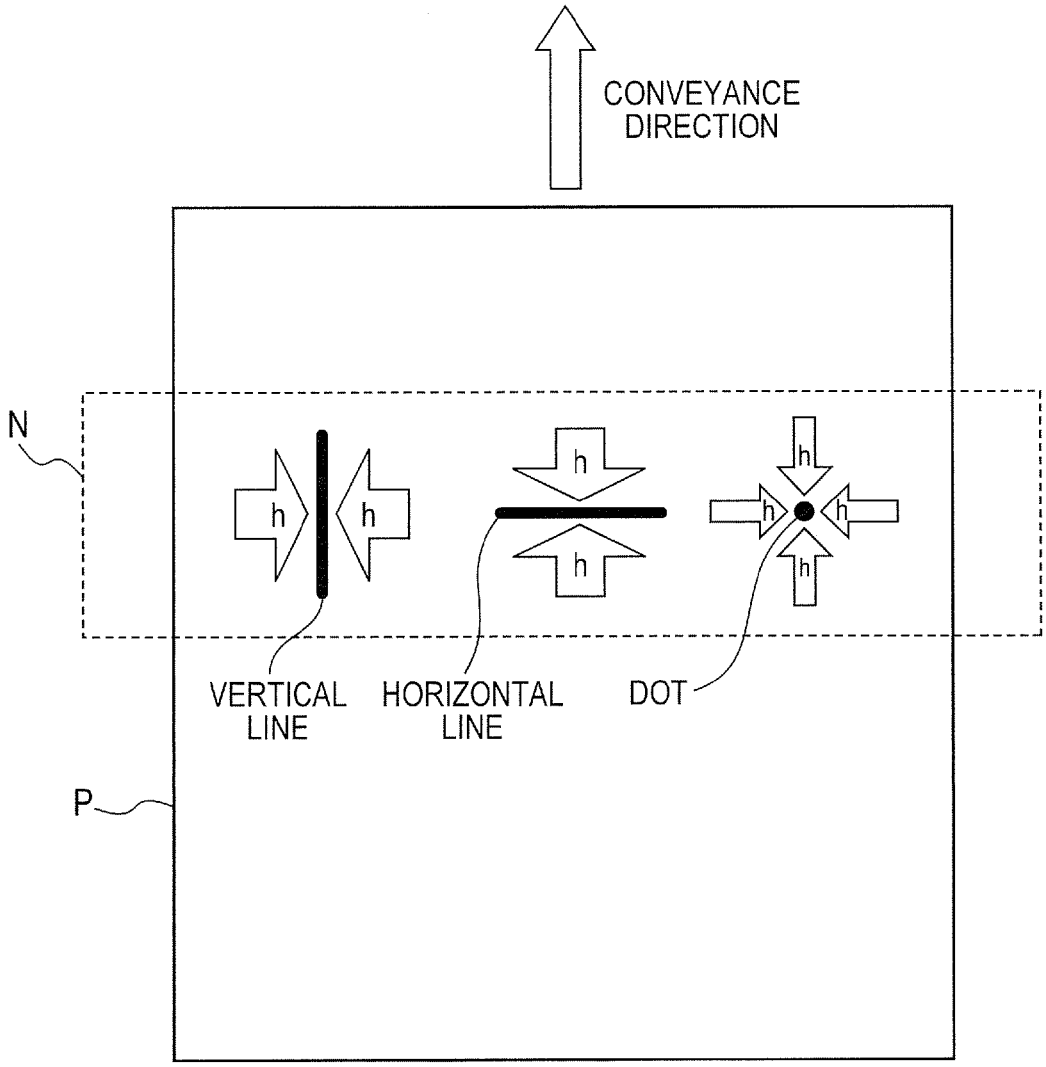
FIG. 9 is a diagram illustrating heat flowing into a print area within a fixing nip portion according to Exemplary Embodiment 1.

The reason why the fixability increases with decreasing line width will be described with reference to FIG. 9. FIG. 9 is a diagram illustrating heat flowing into a print area in the fixing nip portion N.

When the toner image on the recording material P rushes into the fixing nip portion N, heat h migrates or flows into a horizontal line from an upstream side and a downstream side in the recording material conveyance direction, into a vertical line from the opposite sides in a direction orthogonal to the recording material conveyance direction, and into a point from the entire peripheral area; the amount of heat flowing into the image element increases with decreasing print area. This indicates that the fixability is higher for a smaller line width than for a larger print area.

Thus, the area length y in the recording material conveyance direction may be set equal to or smaller than the length of the fixing nip portion N in the recording material conveyance direction. The area lengths x and y may be set as necessary according to the characteristics of the image forming apparatus. The characteristics of the image forming apparatus include the maximum allowable amount of toner per unit area on the recording material, a fixing nip width, and a speed at which the recording material P is conveyed.

Figure 10A:
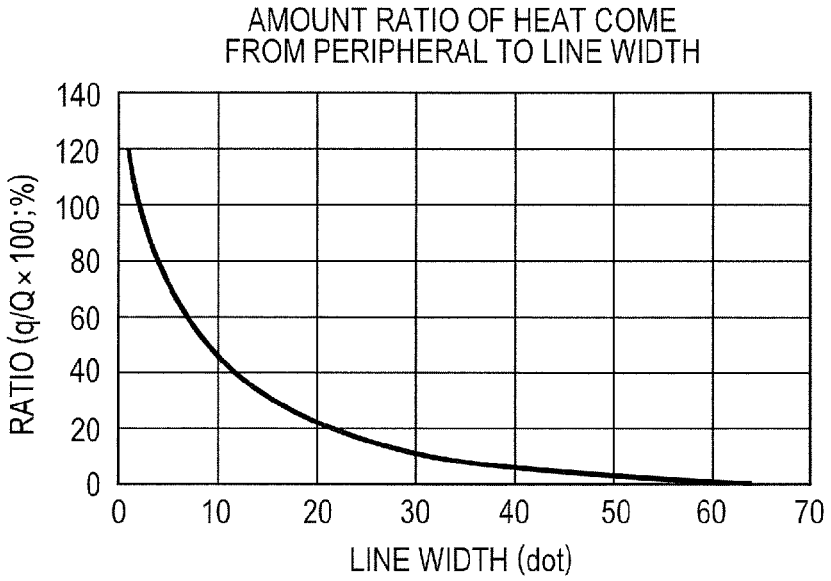
FIGS. 10A and 10B are diagrams illustrating setting of the range of the detection area for density information.
Figure 10B:
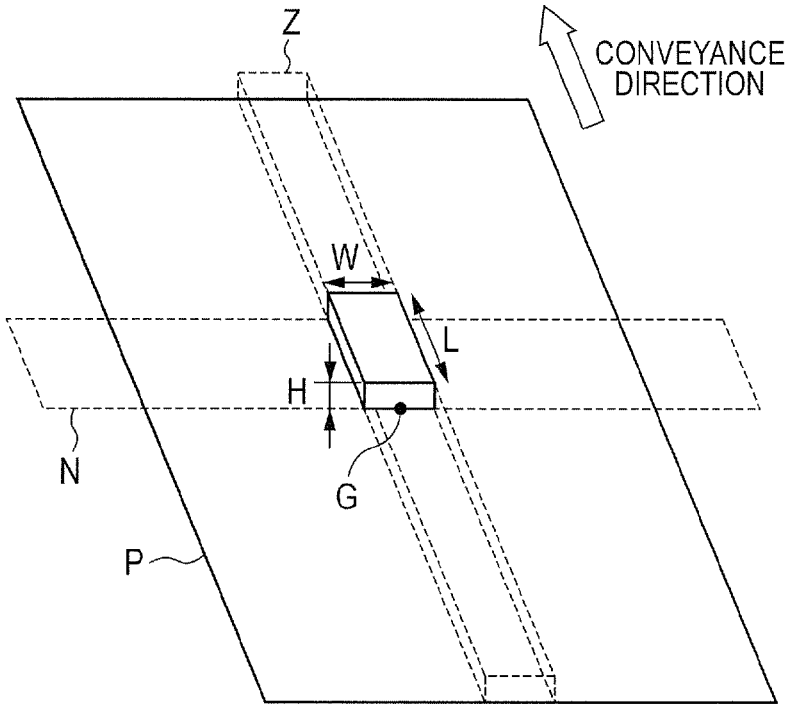

FIGS. 10A and 10B are diagrams illustrating setting of the size (lengths x and y) of each of a plurality of areas into which the image forming area is divided in the present exemplary embodiment. FIG. 10A is a schematic diagram illustrating the ratio of the amount of heat h flowing into a vertical line from its periphery to the amount of heat required to fix the unfixed toner image Z to the recording material simply on heating through the fixing film 22; the ratio is calculated for each line width. FIG. 10B is a schematic diagram illustrating the recording material P and a part of the toner image Z formed on the recording material P which is present in the fixing nip portion N.

Q and q denote the amounts of heat required to make the temperature of a point G reach a deposition temperature in FIG. 10B; the point G is the cross-sectional center of the unfixed toner image Z of a vertical line borne on the recording material P and the interface between the unfixed toner image Z and the recording material P. These amounts of heat are determined by the following equation of heat conduction.

The amount of heat=thermal conductivity×(temperature difference×heat transmission length)×the area of the heat transmission surface×time Here, the surface temperature of the fixing film 22 is denoted by Tf. The temperature of front surface of the recording material P observed during passage through the fixing nip portion N is denoted by Tp. The interface temperature of the interface between the recording material P and the toner image Z during passage through the fixing nip portion N is denoted by Ts. The thermal conductivity of the toner is denoted by λ. Furthermore, as illustrated in FIG. 10B, it is assumed that the vertical line of the toner image Z, when introduced into the fixing nip portion N, has a width (a length in the longitudinal direction; hereinafter referred to as a vertical line width) W, a length L in the recording material conveyance direction (≅the width of the fixing nip portion N), and a height H on the recording material P. Furthermore, the point of time when the recording material P passes through the fixing nip portion is denoted by t. In this case, Q and q can be determined as follows:

$$Q=\lambda\times[(Tf-Ts)/H]\times(W\times L)\times t, \text{ and}$$

$$q=\lambda\times[(Tp-Ts)/(W\times 0.5)]\times(H\times L)\times t.$$

The heat transmission length is (W×0.5) because the point G is the central position of the line width W.

Q is in direct proportion to the line width W, whereas q is in inverse proportion to the line width W. Thus, the ratio of q to Q is also in inverse proportion to the line width W. As illustrated in FIG. 10A, when the line width W is small, the ratio of q to Q is large, but when the line width W is large, the ratio of q to Q is small and is not expected to be effective.

Thus, the lengths x and y may be set when the ratio of q to Q is large.

Furthermore, the fixability is ensured by the inflow of the heat h from the periphery, and thus the adverse effect of the image density around the detection area on the fixability is of concern. However, this poses no problem in a practical sense.

Figure 11A:
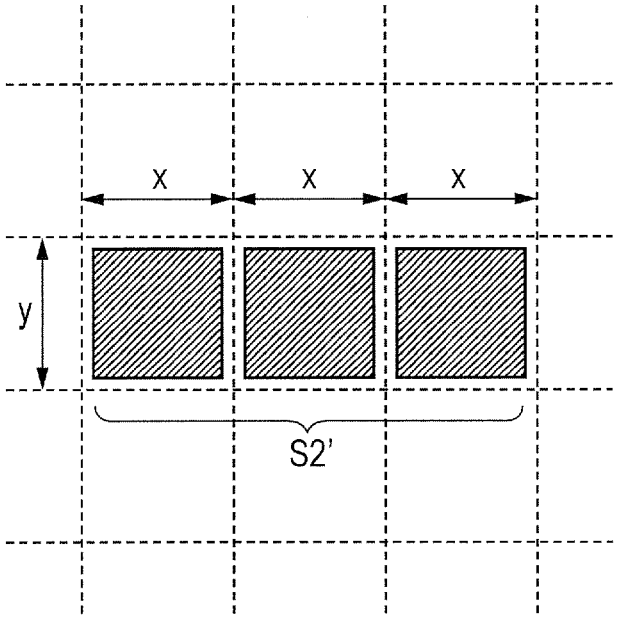
FIGS. 11A and 11B are diagrams illustrating setting of the range of the detection area for density information.
Figure 11B:
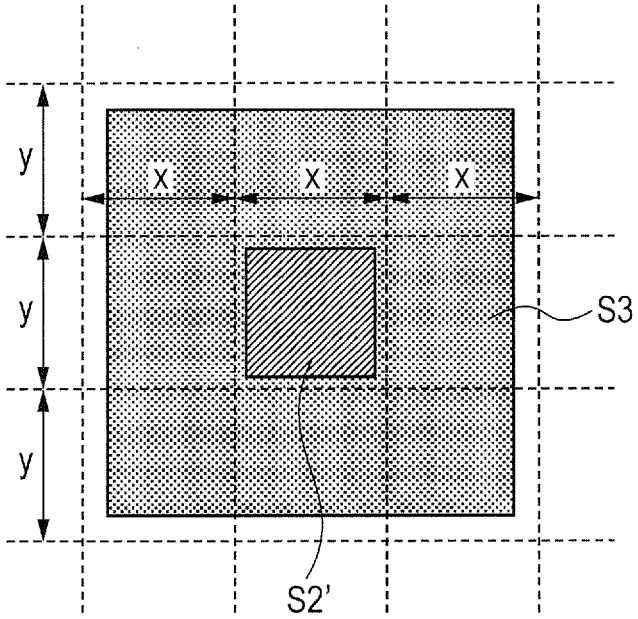

FIGS. 11A and 11B are diagrams illustrating the area size of each of a plurality of areas into which the above-described image forming area is divided and which are each formed of a plurality of pixels in the present exemplary embodiment. For example, if high-density patches (S2') are contiguously arranged which are each smaller than the area as illustrated in FIG. 11A, the fixability may decrease in the central patch. However, the contiguous high-density areas enable even a patch smaller than the set detection area to be detected at a high probability. This allows the fixing temperature to be properly set and prevents the fixability of the central patch from decreasing.

Furthermore, as illustrated in FIG. 11B, the amount of inflow heat h is smaller when a high-density patch is surrounded by a medium-density patch (S3; the density is greater than 100% and lower than 175%) than when the high-density patch is surrounded by solid white. However, the peripheral medium-density patch (S3) covers a wide area, and thus density information for the medium-density patch (S3) is detected at a high probability. As a result, the set fixing temperature is higher than when "the high-density patch is surrounded by solid white and overlooked". This prevents the fixability of the high-density patch from decreasing.

Here, the description of the area size (the predetermined number of pixels) is summarized. The number of pixels that can be fixed at a reference fixing temperature is set to be within the predetermined number of pixels in a case where toner of the toner image formed on the recording material is on only one area of the plurality of areas and a toner density of the toner image on the one area is a maximum toner density that can be set by the image forming apparatus in all the pixels within the area.

Furthermore, according to the present exemplary embodiment, since the line width that makes the fixability fall below the allowable limit is less than 18 dots if the toner image with the maximum density is formed on the recording material P, the area size (the predetermined number of pixels) is set to 324 pixels (18×18). However, the present invention is not limited to this. The area size may be larger than in the present exemplary embodiment if density information can be accurately acquired at a high probability by, for example, changing the position of the representing value for density information within the area as necessary or increasing the number of representative values acquired within the area. Thus, an area with a width larger than the line width corresponding to the fixability allowable limit may be set.

When the number of representative values acquired within the area is increased, the accuracy of the density information is improved, whereas the time required for the acquisition is extended. Thus, the number of representative values acquired may be set according to not only the lengths x and y but also the capabilities of the image forming apparatus and the video controller 51.

As described above, according to the present exemplary embodiment, when density information is acquired from pixel data, the image forming area on the recording material is divided into a plurality of areas each formed of a predetermined number of pixels. Density information on some of the pixels within each area is acquired as a representing value for the area. The fixing condition for the fixing unit is set according to the maximum value of the representative values acquired for all the areas on the single recording material.

Thus, the present exemplary embodiment eliminates the need to acquire density information for all the pixels in the image forming area on the recording material when density information is acquired from pixel data. This enables a reduction in the time required to acquire density information. In particular, when the present exemplary embodiment is applied to an image forming apparatus with a high resolution or a high print speed to allow density information to be acquired in a short time, the density information can be quickly reflected in the fixing condition so as to make the fixing condition compatible with the process of fixing the toner image for which the density information has been acquired. As a result, energy can be saved with proper fixability maintained. Moreover, hot offset and curling of the recording material can be suppressed.

A second exemplary embodiment is described.

An image forming apparatus according to the present exemplary embodiment is characterized by acquiring density information on image data before actually printing the toner image Z on the recording material P, specifically two to several pages before the print page, and setting the fixing temperature according to the density information. The features of the present exemplary embodiment will be described with reference to FIGS. 12A and 12B. A basic configuration of the image forming apparatus according to the present exemplary embodiment is similar to that of the image forming apparatus according to Exemplary Embodiment 1. Components of the image forming apparatus according to the present exemplary embodiment which are similar to those in Exemplary Embodiment 1 will not be described.

Figure 12A:
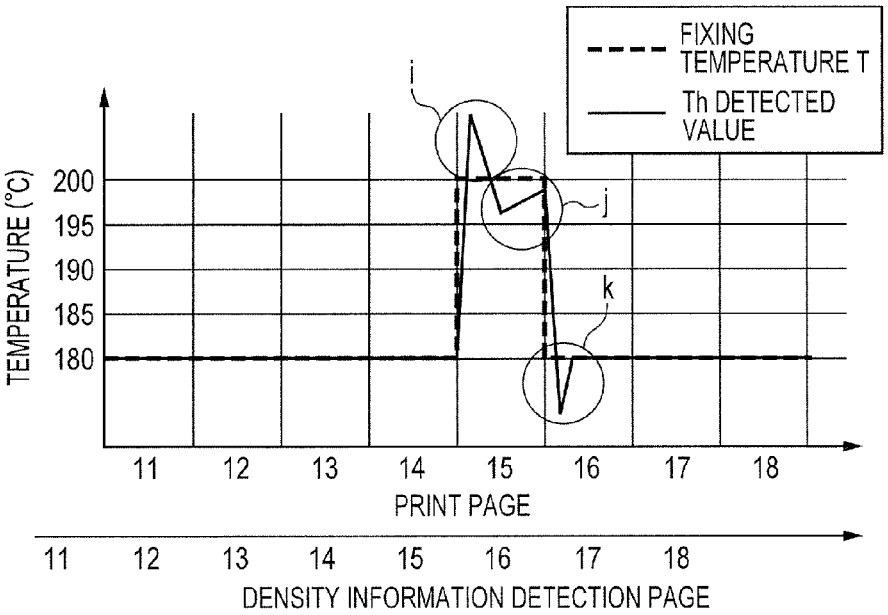
FIGS. 12A and 12B are diagrams illustrating changes in fixing temperature and thermistor detected temperature on a print pages.

FIG. 12A is a diagram illustrating changes in the fixing temperature T for the print page and changes in the temperature detected by the thermistor Th, during continuous printing (images are continuously formed on a plurality of recording materials).

In a comparative example, as illustrated in FIG. 12A, for the 11th to 14th pages during the continuous printing, the value D' is determined to be equal to or smaller than 100%, and the fixing temperature is set to 180° C. For the 15th page, the value D' is determined to be equal to or greater than 175%, and the fixing temperature is set to 200° C. For the 16th and subsequent pages, again, the value D' is determined to be equal to or smaller than 100%, and the fixing temperature is set to 180° C.

In the comparative example, the value D' for the 15th page is detected during printing of the 14th page. Consequently, the fixing temperature T is changed during printing of the 14th page and after the fixing operation on the 14th page is completed. Thus, immediately after the switching, the temperature overshoots (i), and the subsequent fixing control is unstable (j). Furthermore, an undershoot occurs (k) when the fixing temperature T is switched during printing of the 16th page.

Figure 12B:
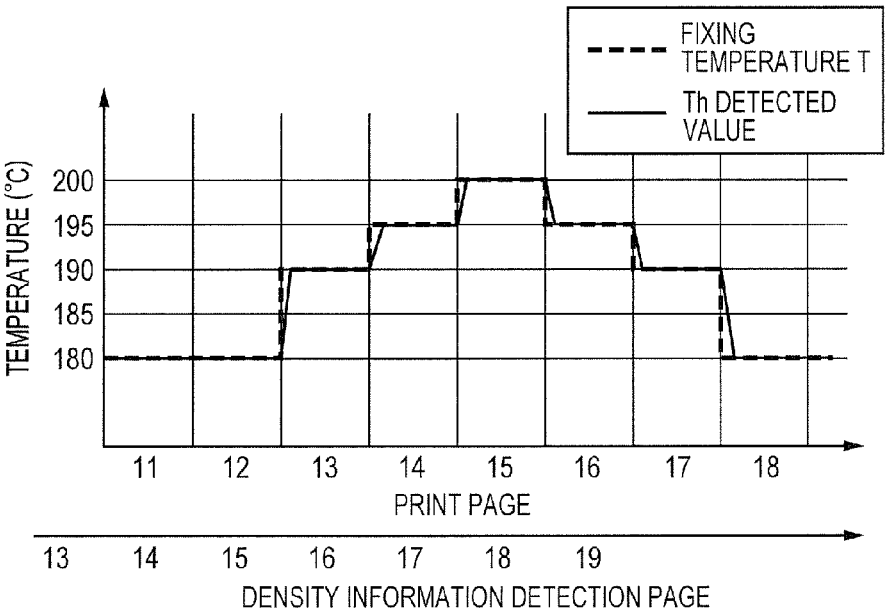

FIG. 12B is a diagram illustrating changes in the fixing temperature T for the print page and changes in the temperature detected by the thermistor Th, during continuous printing in the image forming apparatus according to the present exemplary invention.

In the present exemplary embodiment, as is the case with the comparative example illustrated in FIG. 12A, for the 11th to 14th pages and the 16th and subsequent pages, the value D' is determined to be equal to or smaller than 100%. For the 15th page, the value D' is determined to be equal to or greater than 175%.

However, in the present exemplary embodiment, detection of density information for the 15th page is carried out during printing of the 12th page. The fixing temperature T is set to become gradually closer to 200° C. from the 13th page through the 14th page to the 15th page and to decrease gradually for the 16th and subsequent pages.

Figure 3:
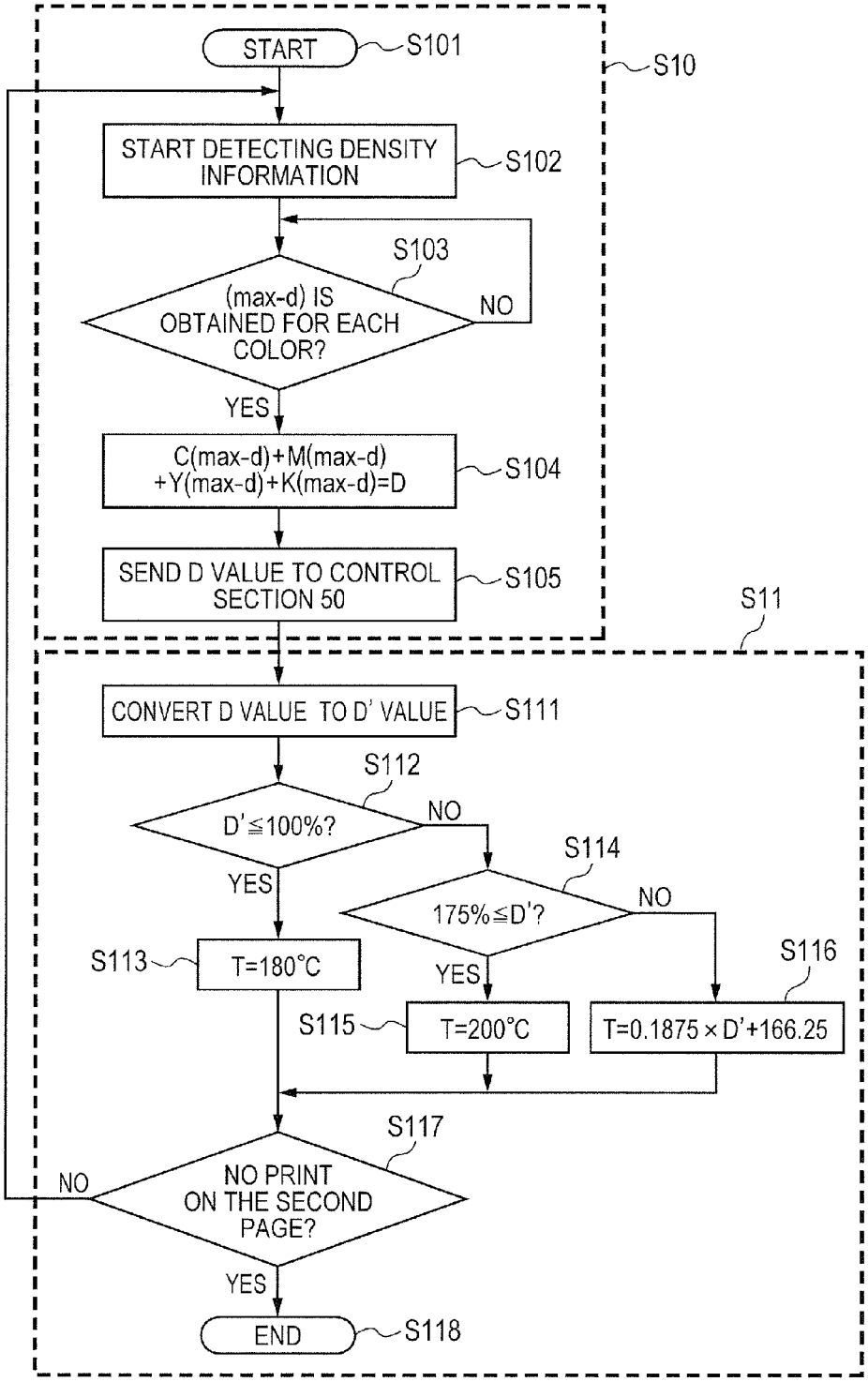
FIG. 3 is a diagram illustrating a flow from detection of density information until a change in fixing temperature.
Figure 4:
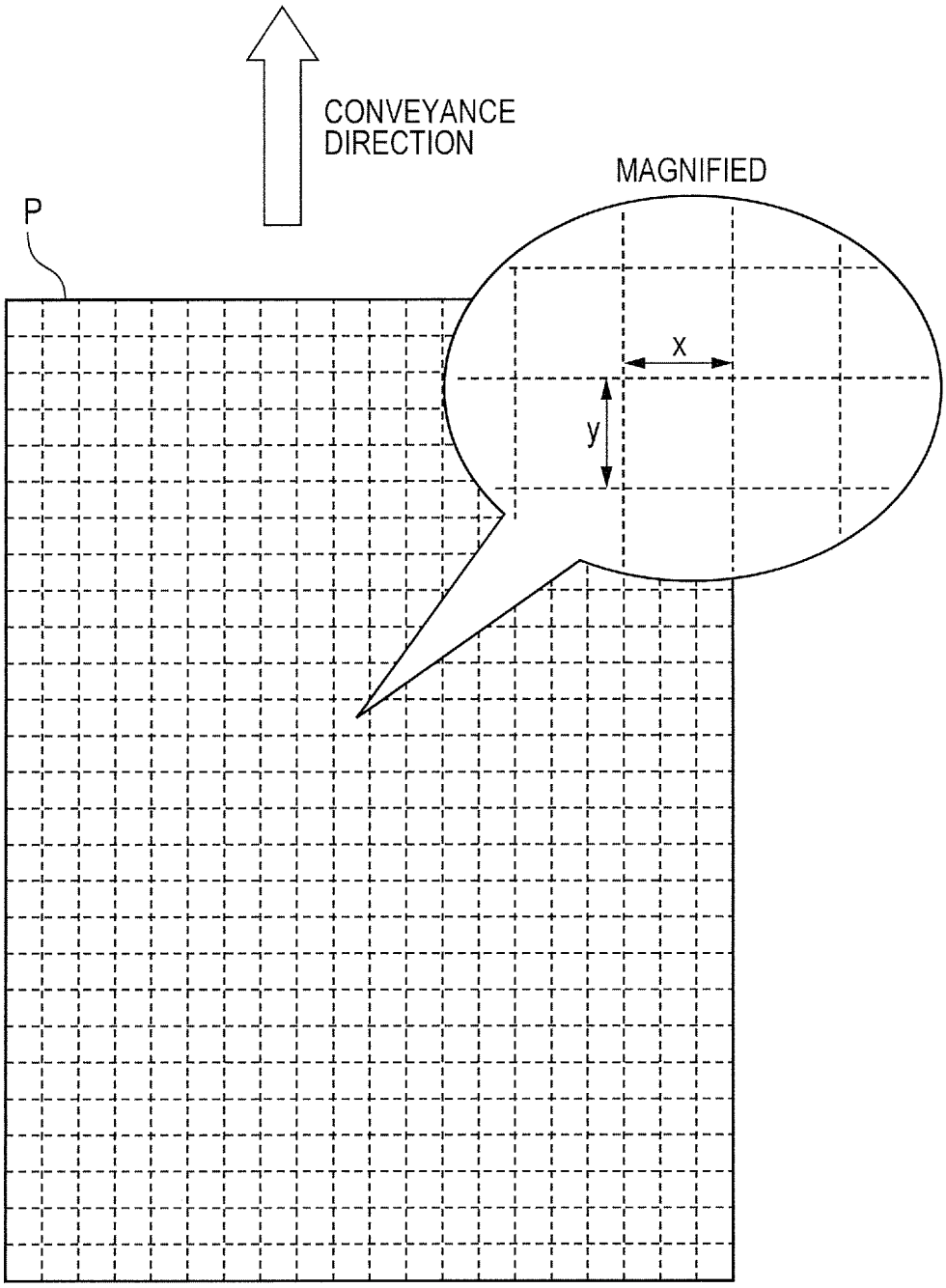
FIG. 4 is a diagram illustrating area division of an image forming area on a recording material according to Exemplary Embodiment 1.

Thus, the present exemplary embodiment is configured such that the fixing condition set in accordance with the flowchart illustrated in FIG. 3 can be changed by the control section 50. The present exemplary embodiment is further configured such that during continuous printing, the control section 50 controllably sets the fixing condition for a recording material before the point of time when the fixing condition set for the preceding recording material can be changed.

This control, compared to the control illustrated in FIG. 12A, allows the temperature from overshooting or undershooting and from being unstable.

Although the fixing temperature is excessively high for the 13th, 14th, 16th and 17th pages, the control may be balanced with the control for the 15th and 16th pages involving the adverse effects of unstable temperature on the images.

Furthermore, if the control method according to the present exemplary embodiment is used to determine the fixing temperature T for the first and second pages after the start of printing, the first printout time may be delayed. Thus, the method may be used after a certain number of pages for the continuous printing have been printed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-178025, filed Aug. 16, 2011, which is hereby incorporated by reference herein in its entirety.

What is claimed is:

1. An image forming apparatus comprising:

an image forming unit configured to form an image on a recording material based on image data;

an acquisition unit configured to acquire density information from the image data;

a fixing unit including a heating member and a pressure member forming a nip with the heating member, the fixing unit being configured to convey and heat the recording material on which the image is formed to fix the image on the recording material at the nip;

a temperature detecting unit configured to detect the temperature of the heating member; and a control unit configured to set a fixing temperature for each of the recording materials and configured to control the amount of power supplied to the heating member so that the temperature detected by the temperature detecting unit becomes the fixing temperature, wherein the acquisition unit acquires the density information of the image to be formed on a first recording material to a N-th recording material in a job in which the image is continuously formed on a plurality of recording materials, N being an integer more than two, and wherein in a case where a density of the image on a k-th recording material is higher than a density of the image on a (k−1)-th recording material, k being an integer equal to two or more or equal to N or less, the control unit sets the fixing temperature of the (k−1)-th recording material to a temperature which is higher than a predetermined temperature predetermined by the density information of the image to be formed on the (k−1)-th recording material and which is lower than a predetermined temperature predetermined by the density information of the image to be formed on the k-th recording material, and wherein the control unit sets the fixing temperature of the k-th recording material to the predetermined temperature predetermined by the density information of the image to be formed on the k-th recording material.

* * * * *